US010982886B2

(12) United States Patent
Viet et al.

(10) Patent No.: US 10,982,886 B2
(45) Date of Patent: Apr. 20, 2021

(54) CONTROL METHOD FOR A COOLING DEVICE

(71) Applicant: ELECTROLUX APPLIANCES AKTIEBOLAGET, Stockholm (SE)

(72) Inventors: Trung Pham Viet, Tyresö (SE); Richard Furberg, Åkersberga (SE); Andreas Aschan, Hägersten (SE)

(73) Assignee: Electrolux Appliances AB, Stockholm (SE)

( * ) Notice: Subject to any disclaimer, the term of this patent is extended or adjusted under 35 U.S.C. 154(b) by 0 days.

(21) Appl. No.: 15/740,826

(22) PCT Filed: Aug. 17, 2015

(86) PCT No.: PCT/EP2015/068817
§ 371 (c)(1),
(2) Date: Dec. 29, 2017

(87) PCT Pub. No.: WO2017/028888
PCT Pub. Date: Feb. 23, 2017

(65) Prior Publication Data

US 2018/0187934 A1 Jul. 5, 2018

(51) Int. Cl.
*F25B 41/04* (2006.01)
*F25B 41/06* (2006.01)
(Continued)

(52) U.S. Cl.
CPC ..... *F25B 41/043* (2013.01); *F25B 40/00* (2013.01); *F25B 41/04* (2013.01); *F25B 41/067* (2013.01);
(Continued)

(58) Field of Classification Search
CPC ..... F25B 2600/2503; F25B 2600/2521; F25B 2600/2519; F25B 2600/0251
See application file for complete search history.

(56) References Cited

U.S. PATENT DOCUMENTS 5,245,836 A * 9/1993 Lorentzen ..... F25B 9/008 62/174
5,253,482 A * 10/1993 Murway ..... F25B 5/02 62/175
(Continued)

FOREIGN PATENT DOCUMENTS

EP 1457744 9/2004
JP 2015014373 A * 1/2015 ..... F25D 21/04
(Continued)

OTHER PUBLICATIONS

International Search Report for PCT/EP2015/068817, dated Apr. 20, 2016, 2 pages.

*Primary Examiner* — Nelson J Nieves
*Assistant Examiner* — Meraj A Shaikh
(74) *Attorney, Agent, or Firm* — Pearne & Gordon LLP

(57) ABSTRACT

Described is, among other things, a method and an apparatus for control of a cooling device. The cooling device comprise a circuit in which a refrigerant fluid is circulated in a fluid path where the circuit comprises a compressor and a condenser provided down streams the compressor. A fluid expansion device is provided down streams the condenser and an evaporator is provided between the fluid expansion device and the compressor. The circuit further comprises a valve provided in the fluid path between the condenser and the fluid expansion device. The method comprises to during an on-cycle of the compressor controlling the valve opening to provide a variable fluid mass flow of the refrigerant fluid circulated in the circuit where the valve opening is controlled to decrease during the on-cycle of the compressor.

15 Claims, 6 Drawing Sheets

| Amb. temp | Pulse ratio (%) – see note | | | | | |
|---|---|---|---|---|---|---|
| 43°C | 70 | 65 | 55 | 50 | 45 | 35 |
| 32°C | 85 | 85 | 70 | 60 | 50 | 45 |
| 25°C | 100 | 85 | 85 | 75 | 60 | 55 |
| 16°C | 100 | 100 | 95 | 85 | 80 | 65 |

(51) Int. Cl.
*F25B 49/02* (2006.01)
*F25B 40/00* (2006.01)

(52) U.S. Cl.
CPC ..... *F25B 49/022* (2013.01); *F25B 2400/0411* (2013.01); *F25B 2600/0251* (2013.01); *F25B 2600/2503* (2013.01); *F25B 2600/2513* (2013.01); *F25B 2600/2515* (2013.01); *F25B 2600/2521* (2013.01)

(56) References Cited

U.S. PATENT DOCUMENTS

| | | | | |
|---|---|---|---|---|
| 8,627,676 | B2 * | 1/2014 | Thiessen | F25B 41/06 62/324.6 |
| 2008/0190125 | A1 * | 8/2008 | Yoshioka | F25D 29/00 62/208 |
| 2009/0216384 | A1 * | 8/2009 | Thiessen | F25B 41/06 700/282 |
| 2010/0005819 | A1 * | 1/2010 | Kawakatsu | F25B 41/062 62/225 |
| 2014/0318161 | A1 * | 10/2014 | Furberg | F25B 41/04 62/115 |

FOREIGN PATENT DOCUMENTS

| | | |
|---|---|---|
| WO | 2007118293 | 10/2007 |
| WO | 2013050055 | 4/2013 |
| WO | 2015086058 | 6/2015 |

* cited by examiner

| Amb. temp | Pulse ratio (%) – see note | | | | | |
|---|---|---|---|---|---|---|
| 43°C | 70 | 65 | 55 | 50 | 45 | 35 |
| 32°C | 85 | 85 | 70 | 60 | 50 | 45 |
| 25°C | 100 | 85 | 85 | 75 | 60 | 55 |
| 16°C | 100 | 100 | 95 | 85 | 80 | 65 |

CONTROL METHOD FOR A COOLING DEVICE

TECHNICAL FIELD

The present disclosure relates to a method for control a cooling device. In particular the present disclosure relates to a control method for controlling a cooling device such as a freezer or a refrigerator.

BACKGROUND

Cooling devices such as refrigerators and freezers or air-conditioners typically transfer heat from inside a refrigeration system to the outside environment by using a hermetic compressor connected to a closed circuit through which a cooling fluid circulates. The compressor has the function of promoting the flow of cooling gas inside this refrigeration system and is capable of causing a pressure difference between the points where the evaporation and the condensation of the cooling gas occur. This enables the heat transfer process to occur and the creation of a low temperature. To cause a pressure difference in the refrigeration circuit, a device called capillary tube or expansion valve is used, depending on the size of the system. For domestic systems a capillary tube is typically used and in large systems an expansion valve is typically used.

The capillary tube is typically sized to a fixed capacity of the compressor and provides a best performance at a certain lift temperature. In U.S. Pat. No. 8,627,626 a system and a method for improving the performance of the system is described. This is in accordance with U.S. Pat. No. 8,627,626 achieved by letting the electronic system of a hermetic variable capacity compressor being configured to control the flow rate of a control valve, to always maintain the fluid passing through the fluid expansion device at the same level as the nominal expansion capacity of the fluid expansion device. Hence, a control valve is provided that can be pulsed based on input signals form a variable capacity compressor.

There is a constant desire to improve the operation of cooling devices and to reduce the cost for operating cooling devices. Hence, there exists a need for an improved control of a cooling device.

SUMMARY

It is an object of the present invention to provide an improved method of controlling a cooling device such as a refrigerator, a freezer or an air-conditioner.

This object and/or others are, at least partly, obtained by the method and cooling device as set out in the appended claims.

As has been realized by the inventors, the optimum expansion is theoretically feasible in every moment of the cooling cycle in which the evaporating and condensing temperature are not constant. This can be called the transient state. In other words optimization for a particular capillary tube can only be achieved at certain working conditions, i.e. it can be optimum at a fixed high and low saturated pressures under a corresponding ambient temperature. This means that it is possible that energy efficiency can be obtained by a dynamically flexible expansion process where the mass flow is controlled.

In case a valve is provided in the flow path between the condenser and the evaporator, the opening of valve can be used to dynamically control the mass flow of the refrigerant circulating in the cooling device. In case the valve is a valve controllable between an open and a closed state the valve can be pulsed with an optimal pulse ratio to provide an optimal flowrate. However, the valve can also be of a type that allow direct control of the mass flow instead of pulsing a valve.

In accordance with one embodiment a method for control of a cooling device is provided. The cooling device comprise a circuit in which a refrigerant fluid is circulated in a fluid path where the circuit comprises a compressor and a condenser provided down streams the compressor. A fluid expansion device is provided down streams the condenser and an evaporator is provided between the fluid expansion device and the compressor. The circuit further comprises a valve provided in the fluid path between the condenser and the fluid expansion device. The method comprises to during an on-cycle of the compressor controlling the opening of the valve to provide a variable fluid mass flow of the refrigerant fluid circulated in the circuit where the fluid mass flow is controlled to decrease during the on-cycle of the compressor by decreasing the opening of the valve.

In accordance with one embodiment the valve is a valve that is controllable to either an open state or to a closed state. In accordance with one embodiment the fluid mass flow is controlled by pulsing the valve. In particular the decreased opening of the valve can be achieved by reducing the opening time during a valve pulse cycle, i.e. the pulse rate.

The compressor can be a fixed speed compressor or in some embodiments variable speed compressor.

In accordance with one embodiment the valve is controlled to be more open in the first time segment. In accordance with some embodiments the opening of the valve is reduced or kept constant for each subsequent time segment in the on-cycle of the compressor.

In accordance with one embodiment a fluid mass flow to be used. The valve opening to be used is stored for each time segment of the on-cycle of the compressor in a memory of the cooling device. In case a pulsing valve is used the pulse ratio can be stored. In accordance with some embodiments the valve opening is set different for different working conditions of the cooling device. The stored valve opening can be stored in a data table. In accordance with an alternative embodiment a time function is used to control the opening of the valve. A working condition of the cooling device can for example be at least one of: the ambient temperature of the cooling device; a difference of temperature between ambient and air inside cabinet(s); the temperature difference between condensing and evaporating temperature of the cooling device, and the compressor power. In case a time function is used to control the opening of the valve such a time function can be a function of time in combination with one or more of the working condition parameters listed above.

The opening of the valve during an on-cycle of the compressor can be predetermined and set before or at compressor start. For example the pulse ratio and its variation during the compressor on-cycle can be set already at compressor start.

The invention also relates to a cooling device such as a refrigerator and a freezer or an air-conditioner having a controller configured to operate in accordance with the above control method.

BRIEF DESCRIPTION OF THE DRAWINGS

The present invention will now be described in more detail by way of non-limiting examples and with reference to the accompanying drawings, in which.

DETAILED DESCRIPTION

Figure 1:
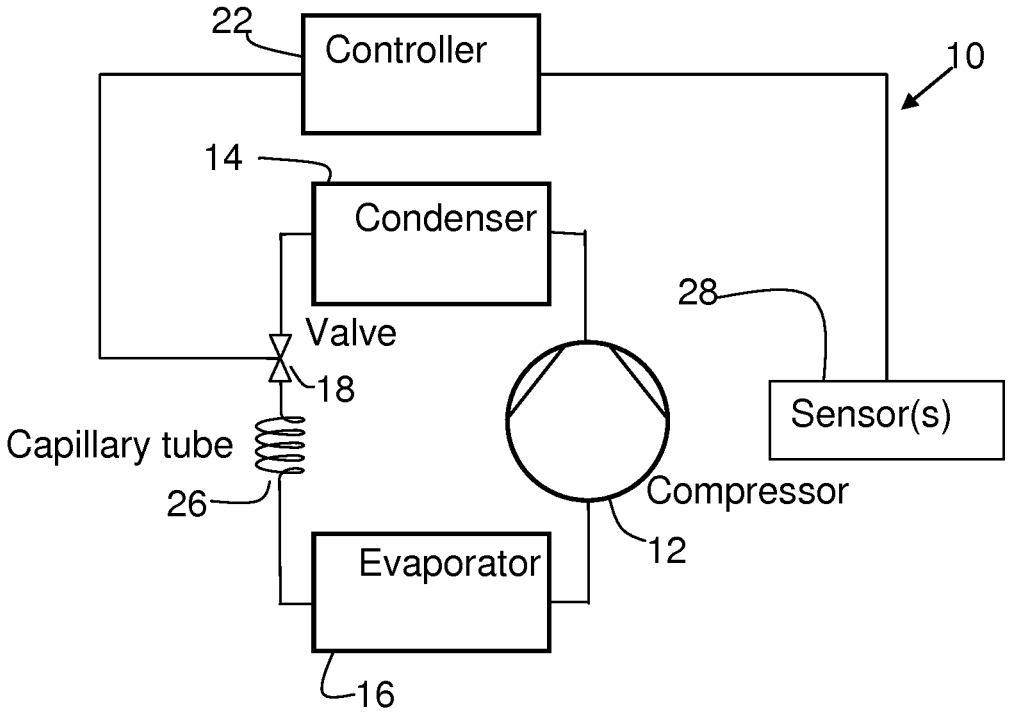
FIG. 1 is a view of a cooling device.

In FIG. 1 a cooling device 10 is depicted. The cooling device 10 can typically be a refrigerator or a freezer, but may also be an air-conditioner. The cooling device 10 comprises a compressor 12, a condenser 14 and an evaporator 16. The cooling device 10 also comprises a valve 18 and a controller 22. The cooling device 10 also comprises an expansion valve 26. The expansion valve 26 can be a capillary tube or a similar device.

The compressor 12, typically a fixed rate compressor but it can also be a variable speed compressor, drives a refrigerant in a cycle whereby the condenser 14 becomes hot and the evaporator 16 becomes cold. Further, in order to reduce energy loss that can occur when the compressor is turned off as a result of hot refrigerant migrating from the hot condenser to the cold evaporator the valve 18 is provided in the path from the condenser 14 to the evaporator 16. The valve 18 can be controlled to be closed when the compressor is in an OFF state thereby preventing the refrigerant from migrating from the condenser to the evaporator when the compressor 12 is not running. When the compressor 12 is in an ON state the valve is open thereby allowing the refrigerant to circulate in the cooling device 10 when the compressor 12 is running. The opening and closing of the valve 18 can be controlled by the controller 22.

Further, different sensors 28 can be used to provide sensor signal that can be used by the controller 22. Non-limiting examples of such sensors can be:

- Temperature sensors to detect ambient and cabinet air temperature.
- Power sensors, such as a current sensor or other types of sensors that can be used to determine the power of the cooling device.

Figure 2:
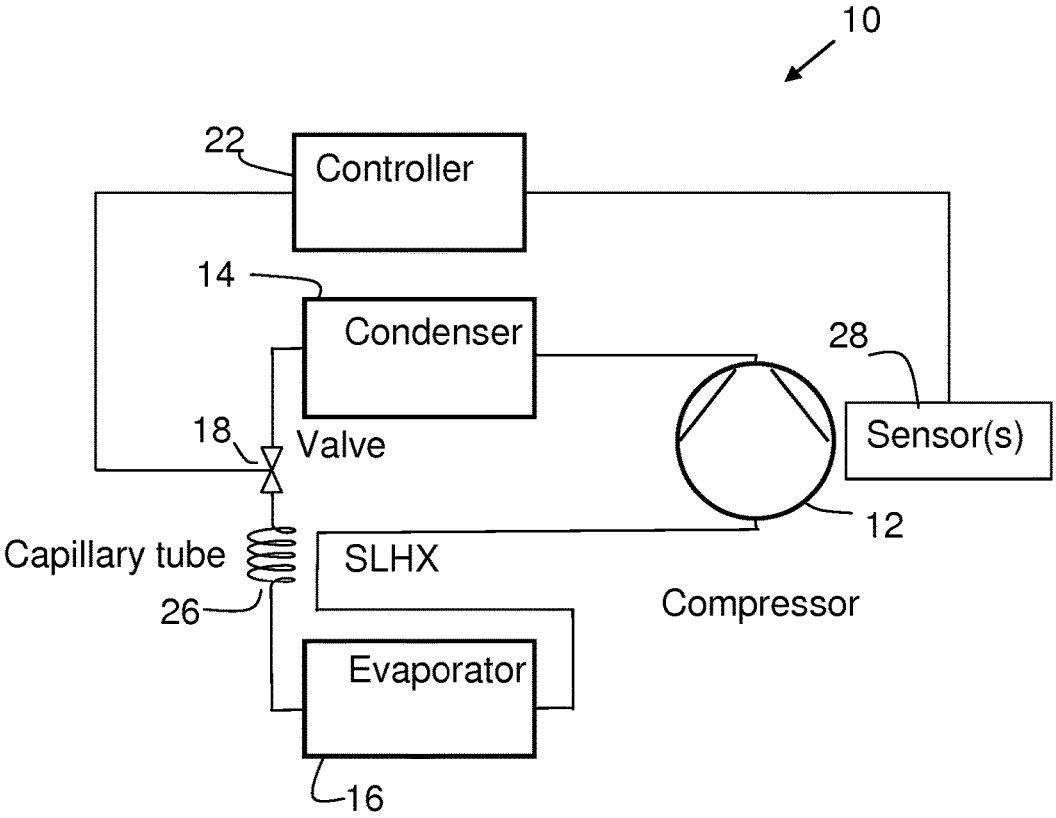
FIG. 2 is a view similar to FIG. 1 and provided with a suction line heat exchanger.

In FIG. 2 a similar cooling device as in FIG. 1 is depicted. In FIG. 2 the cooling device is provided with a Suction Line Heat Exchanger (SLHX).

Figure 4:
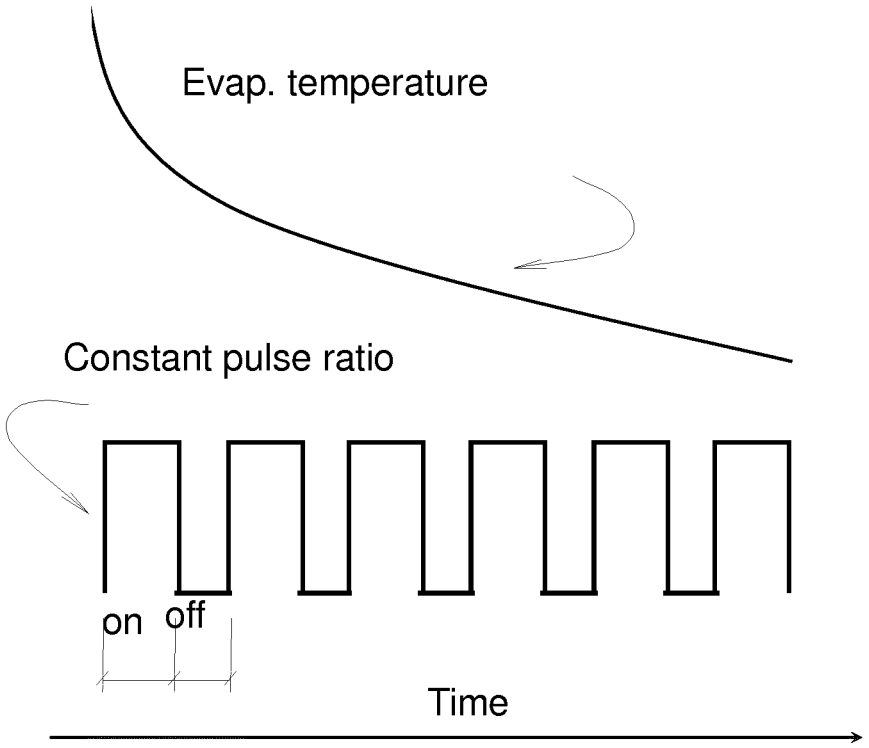
FIG. 4 is a view of a constant pulse ration during an on-cycle of a compressor.

In order to provide an energy efficient control of the cooling device 10. The valve 18 can be controlled to enhance energy performance in the system. This is achieved by controlling the valve to provide a dynamically controlled flow mass of the circulated refrigerant. In case the valve 18 is a valve that is controlled to either an open or a closed state, the valve 18 can be pulsed (i.e. opened and closed) to control the mass flow. FIG. 4 depicts a constant pulse ratio. The pulse ratio will then correspond to a particular mass flow. The pulse ratio is the time during which the valve is opened divided with the time during which the valve is opened and closed (pulse cycle). This will then correspond to the percentage of the time during which the valve is in an open state.

Figure 3:
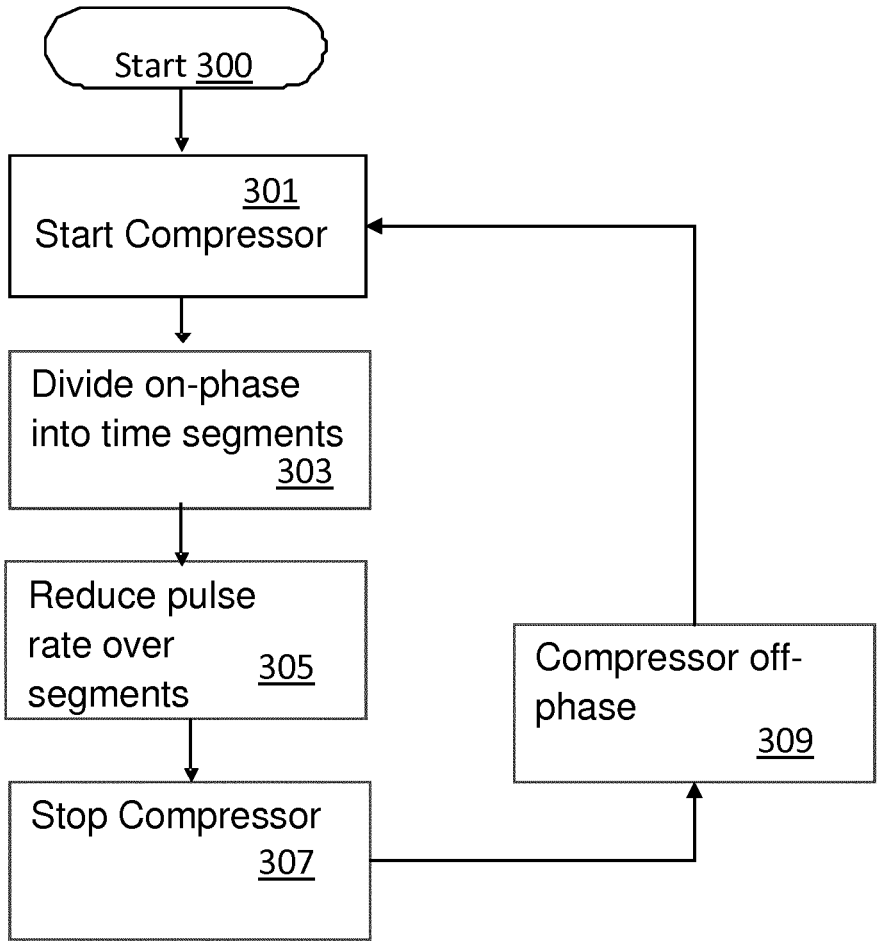
FIG. 3 is a view of some steps performed when controlling a cooling device.

In FIG. 3 some steps that can be performed in a cooling device 10 is shown.

First, the cooling device is in an initial state 300, the state 300 is typically a steady state of the cooling device 10. Next, in a step 301, the compressor is switched on and run for a period of time, run time (RT). When determining the compressor run time (RT), different methods can be used. For example, under a certain cooling capacity of the system, the RT is determined mainly by a set-point of air in cabinet(s), under means of thermostat, and the total cycle time which can be pre-defined. A longer cycle time results the more fluctuation in cabinet's air temperature. However in the end, the mean value of this fluctuation is typically equal to the set-point value.

Another method to determine the RT is so called "cut-in and cut-out". Here a cut-in and a cut-out temperature are pre-defined. This determines the fluctuation as above. In brief, when cabinet air reaches the cut-in temperature, the compressor starts, and it stops when the cabinet air reaches the cut-out temperature. It is here to be noted that if the cooling capacity changed, the RT will be changed respectively. So, when the pulse ratio changes, the RT may also slightly change.

The time during which the compressor is running, run time, is divided into time segments in a step 303. Using a short segment can result in a more accurate pulse rate optimization. However, it depends on the time to close and open the valve. The total number of segments or the lengths of the segments can be selected in response to the length of the running time of the compressor or it can be a fixed number or have a fixed length. The figures given herein are for illustration purposes only and the control is not limited by these examples. Rather, suitable numbers should be selected for each specific implementation.

During the running of the compressor the valve 18 is thus pulsed by controlling the valve to switch between an open state and a closed state. The rate at which the valve is opened and closed is preferably high, but is also limited by the type of valve used and by other factors as set out above, in other words the pulse cycle (open time+closed time) for the valve is short. The pulse ratio, i.e. the time during each pulse that the valve is opened controls the flow rate in the cooling system. The pulse ratio for each time segment is set to a value that is stored in the controller or in a memory from which the controller can read values. In some embodiments the values are different for different ambient temperatures. Other parameters can also be used to control the values controlling the pulse ratio. For example one or more of the ambient temperature of the cooling device; a difference of temperature between ambient and air inside cabinet(s); the temperature difference between condensing and evaporating temperature of the cooling device, and the compressor power can be used to control the pulse ratio used. The pulse ratio is in a step 305 set to decrease during the run time of the compressor. The values stored for a cooling system can for example be as exemplified in FIG. 5.

In accordance with an alternative embodiment a time function is used to control the fluid mass flow. In case a time function is used to control the fluid mass flow such a time function can be a function of time in combination with one or more of the ambient temperature of the cooling device; a difference of temperature between ambient and air inside cabinet(s); the temperature difference between condensing and evaporating temperature of the cooling device, and the compressor power.

As has been realized it can be advantageous to not provide a constant mass flow during the running time (i.e. the ON state/on-cycle) of the compressor as the evaporating temperature is going down and as the condenser pressure is going up, which can be the case when the air temperature in the cabinet of a freezer or refrigerator become colder. When the compressor just started, a maximum flow rate requires the valve to fully open. Later during the running time of the compressor in the cooling cycle the mass flow can advantageously be reduced. In accordance with some embodiments the opening of the valve is higher in the beginning of the running time of the compressor than in the end of the running time of the compressor. The mass flow is therefore controlled to be highest in the beginning of the running time of the compressor and lowest in the end of the running time of the compressor. In accordance with some embodiments the opening of the valve is reduced over the entire running time of the compressor such that for an incremental time segment the opening of the valve (the pulse ratio in case of a pulsing valve) is either constant or reduced. In a cooling device with a pulsed valve this means that the valve becomes closed for longer and longer periods of time during a compressor on-cycle.

In accordance with some embodiments pre-defined pulse ratios are used in every time segment. The pre-defined pulse ratios can be stored in a memory/library of the cooling device or made into a polynomial with which the cooling device is adapted to automatically inter- and extrapolate. Under a certain working condition, the system is run using the pulse ratios obtained from the library. The pulse ratios used can be the pre-defined values for the closest working conditions stored in the memory or an interpolation of several values for two or more working conditions. Thus, if the actual working conditions do not match with the pre-defined values stored in the memory, an interpolation or an extrapolation can be made. In accordance with some embodiments the set of pulsation ratios that are being used during one compressor on time cycle are predetermined before or at the same instance as when the compressor starts. Thus, once the compressor is running, the pulsation ratio is not changed in a response to any input signal other than time from compressor start.

Figure 5:
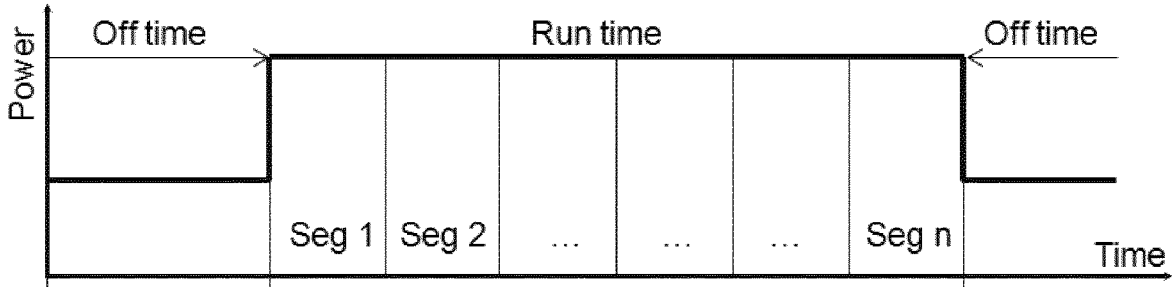
FIG. 5 is a view illustrating different pulse ratios during different time segments of an on-cycle of a compressor.

The pulse ratios stored for a particular time can be different in response to different parameters. Such parameters that can be made to control the pulse ratio at a particular moment can be one or more of:

- Ambient temperature
- Cabinet temperature
- Power of compressor
- Time segment sequence number or time from compressor start
- Condenser temperature
- Condenser pressure
- Evaporator temperature
- Evaporator pressure In FIG. 5 an exemplary data table is depicted. In the exemplary table depicted in FIG. 5 the pulse ratio only depends on time from compressor start and on the ambient temperature. However, as set out above other parameters can be used to set the pulse ratio. As can be seen in FIG. 5, the starting pulse ratio can typically decrease with an increased ambient temperature. Further, the pulse ratio will typically be set to decrease with time from compressor start. Interpolation/extrapolation can be used to determine values at times not having a predetermined pulse ratio. As an alternative the latest pulse ratio used is used until a time with a defined pulse ratio is reached. It is to be noted that the pulse ratios are purely exemplary and different values can be used for different structures and systems.

The control in step 305 of the valve will result in that cooling system runs with different pulse rates and their corresponding duration which are stored in a memory/library. It means that the normal cooling process operates under variable pulse rates during the on-cycle of the compressor. This is to adapt with the transient behaviour of the evaporator and the condenser so as to achieve an improved performance of the system.

Next, in a step 307, the compressor stops. The compressor is then in an off-phase in a step 309, until the compressor is started again in step 301. During the compressor off time the valve could be either in a closed state or open state for the entire off period or during a part of the off period.

Further, under a certain expected cabinet temperature whenever the ambient condition changes, the controller can be adapted to use other values in the library. Hereby it is possible to place the cooling device in different ambient temperatures and still have an optimized energy consumption for the cooling device.

Figure 6:
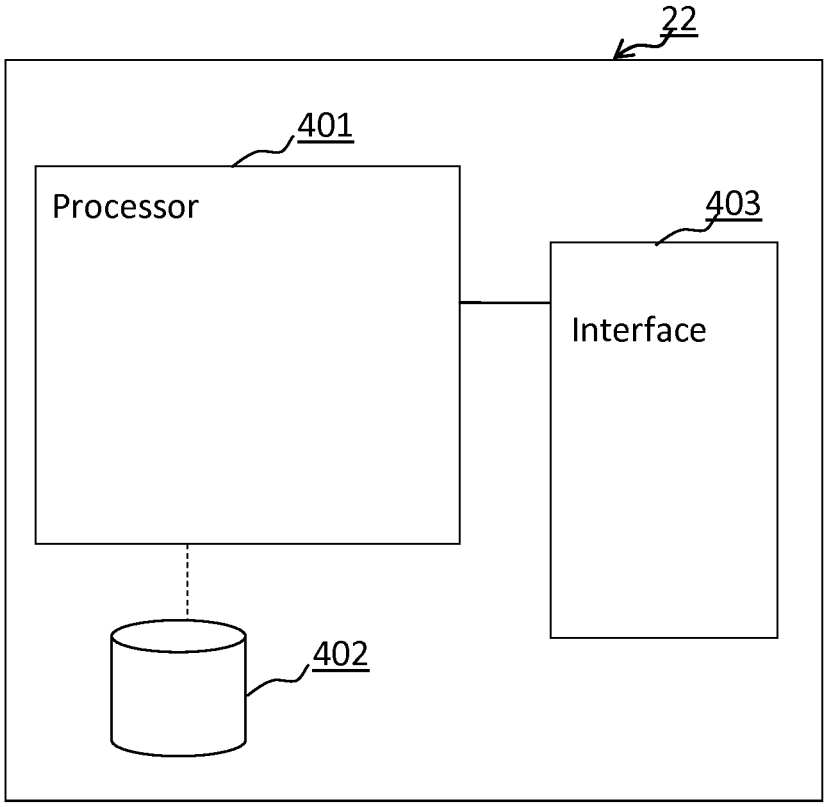
FIG. 6 is a view of a controller.

All of the above steps for controlling the fluid mass flow can be performed by the controller 22. The controller 22 can use as input signal timing signals from the compressor indicating ON and OFF times of the compressor. In some embodiments the ON & OFF time of the compressor will be determined/predefined by the controller 22 itself. The controller 22 can also be provided with different temperature signals so as to be enabled to determine when the ambient temperature changes or when the temperature difference between a cabinet of the cooling device and the ambient air changes and also temperature of the evaporator or condenser. Pressure signals from pressure sensors of the evaporator and condenser can also be provided to the controller 22. Further, the controller 22 can be implemented using suitable hardware and or software. An exemplary controller 22 is depicted in FIG. 6. The hardware can comprise one or many processors 401 that can be arranged to execute software stored in a readable storage media 402. The processor (s) can be implemented by a single dedicated processor, by a single shared processor, or by a plurality of individual processors, some of which may be shared or distributed. Moreover, a processor or may include, without limitation, digital signal processor (DSP) hardware, ASIC hardware, read only memory (ROM), random access memory (RAM), and/or other storage media. The processor 22 is adapted to send and receive signals from other entities using an interface 403.

In the above the valve has been described as a valve being controlled between an open state and a closed state of the valve by pulsing the valve with different ratios. However, it is also envisaged that the valve can be of other types. In particular the valve can be a regulating valve that can be controlled to let through a controlled variable mass flow.

The invention claimed is:

1. A method for control of a cooling device, the cooling device comprising a controller and a circuit in which a refrigerant fluid is circulated in a fluid path, wherein the circuit comprises a compressor, a condenser provided downstream of the compressor, a fluid expansion device downstream of the condenser, an evaporator provided between the fluid expansion device and the compressor, and a valve provided in the fluid path between the condenser and the fluid expansion device, the method comprising during an on-cycle of the compressor, controlling an opening of the valve with the controller to provide a fluid mass flow of the refrigerant fluid circulated in the circuit; and controlling the opening of the valve with the controller to decrease the mass flow of the refrigerant fluid during the on-cycle of the compressor, wherein the on-cycle of the compressor starts when the compressor is turned on and ends when the compressor is turned off, wherein the controller reduces the opening of the valve over the entire on-cycle of the compressor such that the opening is never increased during the entire on-cycle, and for any incremental time segment of the on-cycle the opening is either constant or reduced, and wherein the controller is adapted to perform the method.

2. The method according to claim 1, wherein the compressor is a fixed speed compressor.

3. The method according to claim 1, wherein the compressor is a variable speed compressor.

4. The method according to claim 1, wherein the mass flow of the refrigerant fluid is decreased during the on-cycle of the compressor such that the mass flow is highest at a beginning of the on-cycle and lowest at an end of the on-cycle.

5. The method according to claim 1, wherein the opening of the valve is higher at a beginning of the on-cycle of the compressor than at an end of the on-cycle.

6. A method for control of a cooling device, the cooling device comprising a controller and a circuit in which a refrigerant fluid is circulated in a fluid path, wherein the circuit comprises a compressor, a condenser provided downstream of the compressor, a fluid expansion device downstream of the condenser, an evaporator provided between the fluid expansion device and the compressor, and a valve provided in the fluid path between the condenser and the fluid expansion device, the method comprising during an on-cycle of the compressor, controlling a pulse ratio of the valve with the controller to provide a fluid mass flow of the refrigerant fluid circulated in the circuit; and controlling the pulse ratio of the valve with the controller to decrease the mass flow of the refrigerant fluid during the on-cycle of the compressor, wherein the pulse ratio of the valve is decreased during the on-cycle of the compressor to decrease the mass flow, the pulse ratio being defined as a time in which the valve is open during a pulse cycle divided by the total time in which the valve is open and closed during the pulse cycle, wherein the on-cycle of the compressor starts when the compressor is turned on and ends when the compressor is turned off, wherein the controller reduces the pulse ratio of the valve over the entire on-cycle of the compressor such that the pulse ratio is never increased during the entire on-cycle, and for any incremental time segment of the on-cycle the pulse ratio is either constant or reduced, and wherein the controller is adapted to perform the method.

7. The method according to claim 6, wherein the valve is a valve that is controllable to either an open state or to a closed state.

8. The method according to claim 6, wherein the compressor is a fixed speed compressor.

9. The method according to claim 6, wherein the compressor is a variable speed compressor.

10. The method according to claim 6, wherein the pulse ratio is highest in a first time segment in a sequence of time segments constituting the compressor on-cycle.

11. The method according to claim 10, wherein the pulse ratio is stored for each time segment of the on-cycle of the compressor in a memory of the cooling device.

12. The method according to claim 6, wherein the pulse ratio of the cooling device is set in response to one or more of: the ambient temperature of the cooling device; a difference of temperature between ambient and air inside cabinet (s); the temperature difference between condensing and evaporating temperature of the cooling device; condenser temperature; condenser pressure; evaporator temperature; evaporator pressure; and compressor power.

13. The method according to claim 6, wherein the pulse ratio is predetermined and set before or at start of an on-cycle of the compressor.

14. The method according to claim 6, wherein the mass flow of the refrigerant fluid is decreased during the on-cycle of the compressor such that the mass flow is highest at a beginning of the on-cycle and lowest at an end of the on-cycle.

15. The method according to claim 1, wherein the mass flow of the refrigerant fluid is decreased during the on-cycle of the compressor such that the mass flow is highest at a beginning of the on-cycle and lowest at an end of the on-cycle.

* * * * *